US006564941B2

(12) United States Patent
Hedges

(10) Patent No.: US 6,564,941 B2
(45) Date of Patent: May 20, 2003

(54) FLEXIBLE TRUNCATED-PYRAMIDALLY-SHAPED TOOL AND MATERIAL HOLDER WITH A DISTENDED PAINT PAIL POUCH FOR REMOVABLE USE ATOP A STEP LADDER

(75) Inventor: Kelley Hedges, Valley Center, CA (US)

(73) Assignee: Ladder Boss, Inc., Valley Center, CA (US)

( * ) Notice: Subject to any disclaimer, the term of this patent is extended or adjusted under 35 U.S.C. 154(b) by 0 days.

(21) Appl. No.: 09/735,029

(22) Filed: Dec. 11, 2000

(65) Prior Publication Data

US 2002/0070136 A1 Jun. 13, 2002

(51) Int. Cl.[7] ..... B65D 85/28
(52) U.S. Cl. ..... 206/373; 248/210; 182/129
(58) Field of Search ..... 206/373, 372, 206/349; 182/129; 248/97, 210, 238; 383/39, 40

(56) References Cited

U.S. PATENT DOCUMENTS 4,356,854 A * 11/1982 McGee ..... 182/129
4,363,433 A * 12/1982 Jaques ..... 206/362
5,603,405 A * 2/1997 Smith ..... 206/373
5,622,278 A * 4/1997 Fries et al. ..... 220/480
5,638,915 A * 6/1997 Hardy ..... 182/129
5,647,453 A * 7/1997 Cassells ..... 182/129
5,673,885 A * 10/1997 Pham ..... 248/210
5,749,437 A * 5/1998 Weller ..... 182/129
5,782,314 A * 7/1998 Zeitler ..... 182/129
5,813,530 A * 9/1998 Kornblatt ..... 206/373
5,971,101 A * 10/1999 Taggart ..... 182/129
5,988,383 A * 11/1999 Arnstrong ..... 206/373
6,305,498 B1 * 10/2001 Itzkovitch ..... 182/129

* cited by examiner

*Primary Examiner*—Shian Luong
(74) *Attorney, Agent, or Firm*—Fuess &Davidenas

(57) ABSTRACT

A tool and material holder fitting to the top of a step ladder has an extremely large number of pockets, cavities, loops, clips, hangers, hooks and the like which securely hold a great variety of power and hand tools, caulking guns, paint brushes and paint pads. A major loop maintained open by an insert with a shape memory holds a large paint pail, bucket or can, and is optionally re-sizable to hold one or two smaller cans. A shallow reservoir on a top panel overlying the top step of the step ladder holds small items but still permits standing on the top step.

13 Claims, 5 Drawing Sheets

FLEXIBLE TRUNCATED-PYRAMIDALLY-SHAPED TOOL AND MATERIAL HOLDER WITH A DISTENDED PAINT PAIL POUCH FOR REMOVABLE USE ATOP A STEP LADDER

BACKGROUND OF THE INVENTION

1. Field of the Invention

The present invention generally concerns holders, removably mountable to ladders and step ladders, of paint cans and tools and like implements for use by painters and electricians and other individuals when, in the course of their work, these persons stand on ladders and step ladders. The present invention is directed at a convenient means for carrying and organizing and holding various work supplies and work implements in proximity to work conducted by a tradesman from a ladder or step ladder.

The present invention particularly concerns flexible tool and paint pail holders that removably mount atop step ladders so that a workman (i) may conveniently transport tools and supplies, including paint, to the ladder within a holder, (ii) may easily and securely mount a holder to the ladder, (iii) may have convenient access to tools and supplies held within the holder while standing on the ladder, and (iv) may at any time replenish any tools or supplies within the holder with minimum disruption.

2. Description of the Prior Art

Ladders have been employed since their inception to place a worker into proximity to an elevated surface or article that needs be physically manipulated, such as for purposes of painting, plumbing, wiring etc. Of the several well-known styles of ladders available, a step-ladder consists of (i) a fixed ladder member which is joined to (ii) a supporting member having dimensions and construction similar to that of the fixed ladder portion but designed primarily as a support. The (i) fixed ladder member and the (ii) supporting member are joined by a suitable hinge, transverse to the long axis of both members, such that the ladder member and support member may be opened with respect to one another, forming thereby an essentially A-frame configuration. A top step is usually provided at the external apex of the "A".

This step ladder provides the ability to elevate ones-self in the absence of a fence, wall or other structure normally required when using a fixed ladder alone. It is to users of the step-ladder which the present invention is directed, but the principles of the present invention, particularly in the aspect of its paint pail pouch, are anticipated to be useful on the other types of ladders as well, and it would be unnecessarily restrictive to view the particular application of the present invention to step ladders as is taught within this specification as being delimitive of the invention.

One of the problems individuals who find themselves on ladders regularly encounter is that they must prevent themselves from falling from the ladder while performing the task at hand. Additionally, a variety of hand-implements are often required to carry out various tasks to their completion. From a statistical standpoint, the probability of an individual having a mishap varies directly as the number of times an individual goes up and down from the ladder in connection with a job. Therefore, if it were possible to minimize the number of up-and-down trips an individual was required to make in the normal course of carrying out tasks from a ladder, then the probability of a mishap could be accordingly minimized.

One way to minimize the number of up-and-down trips required to carry out a task is to provide every tool and/or material needed for a given job in close proximity to the location atop the ladder where the worker is situated. However, while the prior art contains many different types of devices aimed at this end, none has been successful in design both so as to be (i) ergonomically effective, and (ii) sufficiently cost-effective of manufacture so as to be widely adopted.

A review of some of the criteria that a ladder, or step-ladder, tool holder would desirably realize is useful. Flexible and removable, fabric-type, holders seemingly offer a large holding capacity, but these holders tend not to maintain a defined volume, and are subject to collapsing inward. This is adverse in that even a loaded holder should be capable of being slipped into position on or atop a step ladder by use of but one hand, making that the holder must maintain itself open and ready to receive mounting upon the step ladder. Moreover, a holder removed from a ladder mounting should not slump or collapse so completely that held objects such as tools become dislodged.

An optimally commodious tool holder would seemingly best make good use of every one of the five exterior surfaces of defined by the volume in the shape of a truncated four-sided pyramid at the top of a step ladder. Use of the substantially flat top surface to the step ladder is immediately problematic. Should this surface be left unencumbered so that it may be stood upon, or should it be adapted for holding objects or things?

Finally, the retention of paint cans and pails both large and small is potentially challenging to flexible fabric holders, especially as these containers and their contents would desirably be held level.

Attempts to solve these challenges are shown in various issued United States patents.

U.S. Pat. No. 6,116,419 to Campagna, et al. for a LADDER POUCH shows an elongate, flexible sheet having a first end, a midpoint, a second end, a first side, and a second side. A first engagement structure, such as hook and pile fastening material, is located on the first side of the elongate, flexible sheet between the midpoint and the first end. A second engagement structure, complimentary with the first engagement structure, is located on the second side of the sheet proximate its second end. Multiple pockets are disposed on or integral with the first side of the sheet. The pockets can be open-mouthed or include covering flaps.

U.S. Pat. No. 5,988,383 to Armstrong for a LADDER SADDLE DEVICE shows a holder device containing various work implements designed for use by workers who regularly use ladders. The device holds the implements in such fashion as to be ergonomically accessible while maintaining a reduced center of gravity and hence increased stability of the ladder/device combination as a whole. Use of this device is claimed to increase safety while being cost-effective enough in its construction to be readily employed by workers in various crafts and professions.

U.S. Pat. No. 5,971,101 to Taggart for an ADAPTABLE CARRIER APPARATUS shows a tool and material carrier adaptable for use on a variety of platforms such as four and three legged step ladders, extension ladders, universal or hinged ladders, platform ladders, scaffolding and the like. The carrier is made of a foldable body which conforms to various platform deigns. A multiple strap system having quick lock and release connectors secures the carrier to the various platforms. The front of the body includes a multi-tiered system of pouches and holders for tools and materials.

The rear of the body includes additional pouches or holders. The carrier includes a holster for gun shaped tools. An electric cord holder provided with or separately from the carrier holds an electric cord close to the working elevation of the platform. The electric cord holder includes a foldable strap having two portions which are mated when the strap is folded to form an opening smaller than the head of an electric cord to secure the electric cord between the two portions. Modular, task specific, attachments to the carrier provide additional versatility such as an attachable mud pan and mud knife holder or an attachable butane torch holder.

U.S. Pat. No. 5,749,437 to Weller for a FREE-STANDING LADDER SUPPORTED TOOL HOLDER concerns a non-obstructive tool holder which holds tools on a free-standing ladder, e.g. a step-ladder. The tool holder is configured so avoid obstruction of normal use of the free-standing ladder. The tool holder has a skirt including a front side sheet, a rear side sheet, a left side sheet, and a right side sheet connected together at sides thereof to form a generally tubular structure having a top opening and a bottom opening. The skirt narrows towards the top thereof. The front side sheet, the rear side sheet, the right side sheet, and the left side sheet each are made of a substantially flat but flexible material. The sides include pockets, and/or other supports, for holding tools. The top opening exposes the top platform of the ladder. A handle extends across the top opening, the bottom of the handle rests on the top platform of the free-standing ladder so that the top platform will remain unobstructed in normal use of the free-standing ladder. In addition, the front side sheet is shortening and includes an elastic portion whereby the use of the ladder is further unobstructed.

Finally, U.S. Pat. No. 5,647,453 to Cassells for a MULTI-PURPOSE LADDER APRON shows a multi-purpose ladder utility apron having four side panels, each adapted with a plurality of tool and accessory receptacles. The apron further includes a fold up storage tray on the ladder's top providing additional temporary storage space. Closure flaps and straps secure the apron to the ladder whether in its open or closed position such that the subject invention may be secured to the ladder during use, transport and storage and may be quickly removed for laundering. An optional lid is also pivotally attached to the apron and folds out to provide a work shelf. The apron's design accommodates use of the ladder's own fold-down shelf and permits use of all steps without sacrificing storage space for tools and the like. The apron may still further be adapted with a power receptacle so that power tools can easily be interchanged without disengaging the extension cord.

The prior art in general variously shows ladder-mounted tool holders with various accommodations to holding and supporting various special things, mostly tools and materials. The mode and manner by which an economically-constructed flexible fabric-based tool holder might reliably function both on and off a ladder, and particularly a step ladder, could, however, use improvement.

SUMMARY OF THE INVENTION

The present invention contemplates a flexible and collapsible multi-pocket truncated-pyramidally-shaped tool and material holder for removable use atop a step ladder. The holder removably fits to the top of a step ladder, there presenting (i) a large distended pouch suitable to receive and hold a paint can, (ii) a flat tray which doubles as the top step of the step ladder, and (iii) numerous other hooks, hangers, clips and the like from which various tools and materials may conveniently be hung. The step ladder tool and material holder is preferably made from canvas or cotton duck, nominally of 24 oz. weight, or from polyurethane coated cloth, by processes of sewing and/or gluing. So constructed with the five major surfaces of its main body in the shape of a truncated four-sided pyramid, the tool and material holder has adequate stability so that it (i) may be set upon a floor without collapsing, and (ii) may be picked up with but one hand to be set atop a step ladder.

The preferred tool and material holder, called a "ladder caddy", has numerous attributes. It is characterized for having an extremely large number of pockets, cavities, loops, clips, hangers, hooks and the like which securely hold a great variety of power and hand tools, caulking guns, paint brushes and paint pads. Importantly, the holder has in particular a major loop—maintained open by an insert with a shape memory—for holding a paint bucket, most preferably of the two gallon size. A paint bucket—even when full—may be entered into, or withdrawn from, this supporting loop by use of but one hand. The bucket is held securely within the loop with its lip exposed—exactly as desired for painting.

There are preferably 39 or more pockets in the holder, a number more than 50% greater than the 24 pockets normally found in the most extensive riggers bag. This is in addition to, most preferably, 1 drill holster, 2 hammer/caulking gun holder loops, 1 electrical or masking tape roll holder, 1 key clip, 4 general purpose hooks and 4 general purpose tie tabs.

The stiffening member with shape memory for the loop, or pouch, that holds the paint bucket is normally a piece of plastic.

The plastic stiffening member causes the loop, or pouch, to distend when the receptacle is mounted to the top of a step ladder, making that a paint can may easily and reliably be entered into, and withdrawn from, the pouch by the use of but one hand.

This major loop is further, optionally, fitted with a down-hanging skirt, and in this case the stiffening member also preferably has and presents a transverse extension which, when the receptacle is mounted to the top of step ladder, extends downwards into the skirt, holding neatly open a pouch thereby formed, with pockets to the pouch exterior being smartly presented. The downhanging skirt may also optionally have vertical strip of hook and loop material sewn on its interior wall roughly midway in its looping extension. This optional strip is matched to a like optional strip of complimentary hook and loop material that is located an a major surface positioned against the step ladder, The two complimentary strips are roughly opposite—180° across—the pouch of roughly circular cross-section. When the pouch is empty the two complimentary strips may be forced together, making the one, relatively larger, paint can pouch into a dual pouch for holding two relatively smaller paint cans, normally of one quart size. This "closure" or "constriction" of the pouch may be realized despite the presence of the stiffening member. The step ladder top receptacle of the present invention thus has a pouch that is optionally adaptably sized to two differently sized paint cans. As before, smaller paint cans can be entered into, and withdrawn from, the modified pouch with but one hand.

An area of the tool and material holder which is immediately over the top step of the step ladder, and which is relatively flat in use, is provided with a slightly raised rim, making a shallow tray feature where small objects such as screws and nails may be temporarily held without rolling off. Nonetheless to the presence of this shallow tray feature, the top surface of the holder may be stood upon, making that the top step of the step ladder is still available for use.

The top surface also presents mounting/un-mounting and carrying handles, preferably two such spaced-parallel on either elongate side of the shallow tray feature. When the two handles are grasped by the thumb and fingers of a one hand, it is possible to lift the entire receptacle, and all the contents thereof including any small items that may be within the tray, on and off the top of a step ladder, and to carry the receptacle and all its contents.

1. A Holder Device with a Loop for a Paint Pail

Accordingly, in one of its aspects the present invention is embodied in a holder device for holding various things including a paint pail at an apex of a step ladder.

The device has a) a rectangular top panel having four edges; b) a trapezoidally-shaped first side panel (i) connected at its first edge to a first edge of the top panel, and (ii) having a plurality of receptacles; c) a trapezoidally-shaped second side panel (i) connected at its first edge to a second edge, opposite to the top panel's first edge, of the top panel, and (ii) having a plurality of receptacles; d) a step-side panel (i) connected at its first edge to a third edge of the top panel, and also to a second edge of both the first and the second side panels, and (ii) having a plurality of receptacles; e) a front panel, connected at its first edge to a fourth edge of the top panel and also to a third edge, opposite to the second edges, of both first and the second side panels. To this structure in the substantial shape of a truncated four-side pyramid is added f) a loop member extending substantially level with the top panel from (i) where the top panel joins with the first side panel and the front panel (ii) in an arc to (iii) where the top panel joins with the second side panel and the front panel, so as to form a loop into which a paint can is suitably entered and held.

The loop member preferably contains a shape memory stiffening element, preferably plastic, for maintaining the arc of the loop into which the paint can is suitably entered and held even when the paint can is not present.

The loop member further, optionally, includes a downhanging skirt protecting and securing a cylindrical surface of a paint can entered into, and held by, the loop member. This downhanging skirt may optionally incorporate a substantially vertical strip of a first type of hook-and-loop fabric, in which case the front panel also includes a substantially vertical strip of a second type of hook-and-loop fabric complimentary to the first type. By this construction the strips of the downhanging skirt and of the front panel may be manually pressed together, causing the strips to hold together along their lengths so as to divide the major arc of the loop member into two smaller arcs each of which is suitable to receive and to hold a paint can of appropriate size.

The top panel preferably includes a peripheral rim (i) sufficiently high so as to form a shallow reservoir in which can be placed nails and screws and other small things without jeopardy that they will role off the holder device and the step ladder, but (ii) insufficiently high so as to preclude that a person should not stand upon the top panel and its rim and its reservoir, obtaining good and secure footing like as the person would obtain standing directly upon the top step of the step ladder.

The preferred connection of all panels is by sewing.

2. A Holder Device with a Top Tray

In another of its aspects the present invention is embodied in a holder device for holding various things at an apex of a step ladder, including on the level surface of the top step of the step ladder.

The holder device so functioning includes a) a rectangular top panel having (i) four edges and (ii) a peripheral rim sufficiently high so as to form a shallow reservoir in which can be placed nails and screws and other small things without jeopardy that they will role off the holder device and the step ladder, but insufficiently high so as to preclude that a person should not stand upon the top panel and its rim and its reservoir when the holder device is mounted at the top step of the step ladder.

The holder device further includes b) a trapezoidally-shaped first side panel (i) connected at its first edge to a first edge of the top panel, and (ii) having a plurality of receptacles; c) a trapezoidally-shaped second side panel (i) connected at its first edge to a second edge, opposite to the top panel's first edge, of the top panel, and (ii) having a plurality of receptacles; d) a step-side panel (i) connected at its first edge to a third edge of the top panel, and also to a second edge of both the first and the second side panels, and (ii) having a plurality of receptacles; and e) a front panel, connected at its first edge to a fourth edge of the top panel and also to a third edge, opposite to the second edges, of both first and the second side panels.

By this construction the connected panels constitute the holder device that is suitably mounted at the top step of a step ladder. The top panel overlies the top step, with the step-side panel overlying an uppermost portion of a step side of the step ladder, with the front panel overlying an uppermost portion of a front side of the step ladder, and with each of the two side panels overlying regions between the step side and the front side of the step ladder.

This holder device with a shallow reservoir further preferably includes f) a loop member extending substantially level with the top panel from (i) where the top panel joins with the first side panel and the front panel (ii) in an arc to (iii) where the top panel joins with the second side panel and the front panel, so as to form a loop into which a paint can is suitably entered and held.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow.

DESCRIPTION OF THE PREFERRED EMBODIMENT

The following description is of the best mode presently contemplated for the carrying out of the invention. This description is made for the purpose of illustrating the general principles of the invention, and is not to be taken in a limiting sense. The scope of the invention is best determined by reference to the appended claims.

1. Objects of the Invention

In accordance with the shortcomings contained in the prior art, it is an object of the present invention to provide a convenient device through the use of which laddermen may minimize the number of up-and-down trips required them on a given task.

It is an object of this invention to provide a means for caddying tools used by laddermen.

It is a further object of this invention to provide a means for caddying tools used by laddermen which is ergonomically enjoyable.

It is a further object of this invention to provide a means for caddying tools used by laddermen which is cost-effective enough in its manufacture to gain wide acceptance by industry.

Finally, it is yet another object of this invention to provide a means for caddying tools used by laddermen which is useful by tradesmen in all fields.

As an added advantage, the instant invention eliminates the need for the workman to carry heavy tools on his belt which might otherwise tend to contribute to a situation of imbalance, which could catalyze a mishap.

The objects of this invention are achieved by providing a novel fabric hood which is affixable to the top portion of the step-ladder. The uppermost two rungs (including the top rung) and the frame members of the ladder join together so as to form the framework of an essentially trapezoidally-shaped, or, more precisely, a truncated-pyramidally-shaped volume at the top of the step-ladder. The hood of the present invention is shaped so that it encloses this volume in the shape of a truncated four-side pyramid. The hood of the present invention also comprised pocket portions on its surfaces in which various tools and other implements such as screws, solder, nails, hammers, saws, wrenches, etc. may be securely housed.

An unexpected advantage of the present invention is that the hood contributes to the structural strength of the ladder and provides increased traction for the topmost step.

A further unexpected advantage of the present invention is that the center of gravity of the ladder to which the instant device is attached is reduced by virtue of the locations of the tools and implements held being lower than they would be if within a tool box resting on the top step of the ladder. This increased stability contributes to safety.

2. Preferred Embodiment of the Invention

Figure 1:
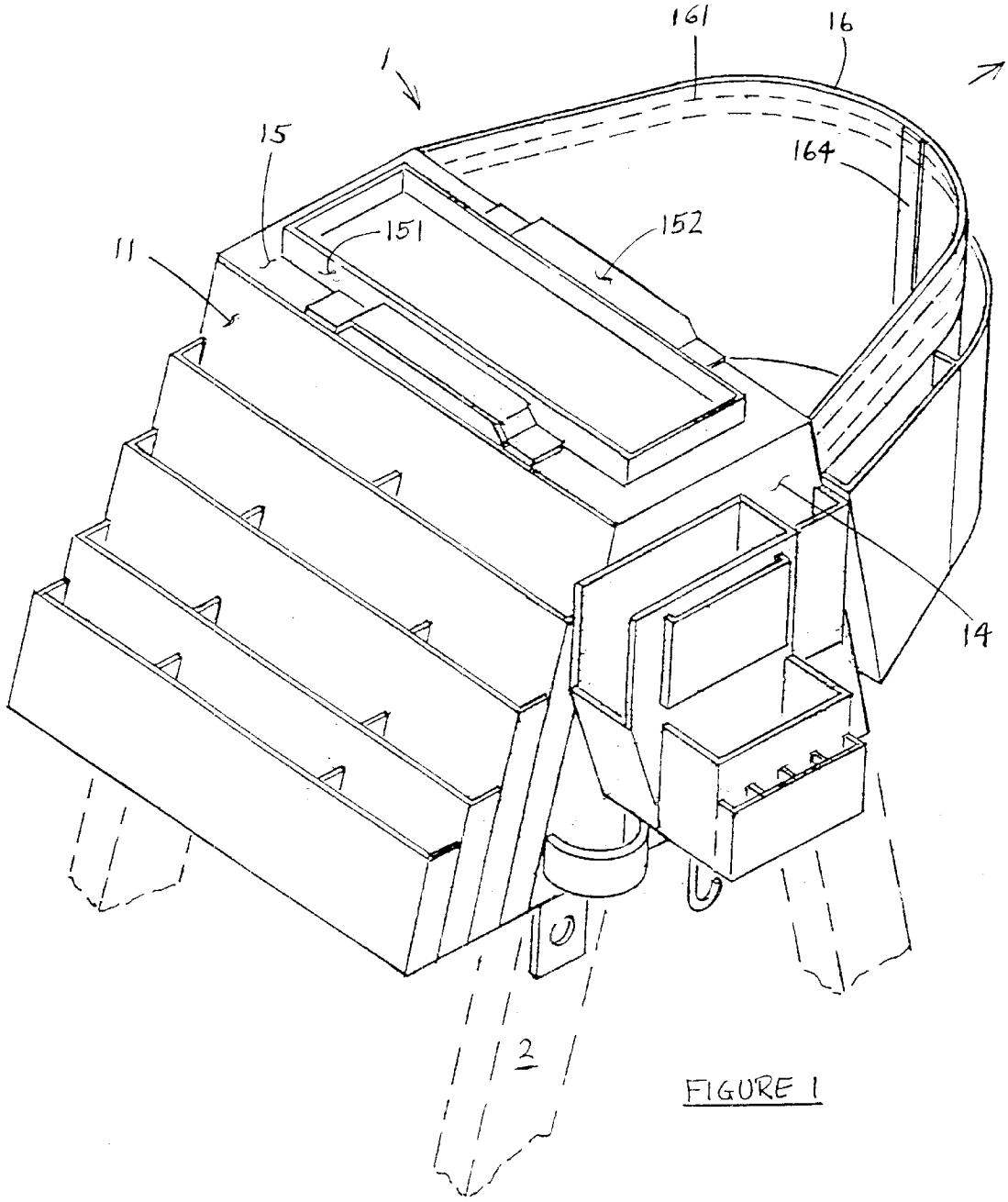
FIG. 1 is a first diagrammatic perspective view of the preferred embodiment of a flexible truncated-pyramidally-shaped tool and material holder in accordance with the present invention in operative position atop a step ladder.
Figure 2:
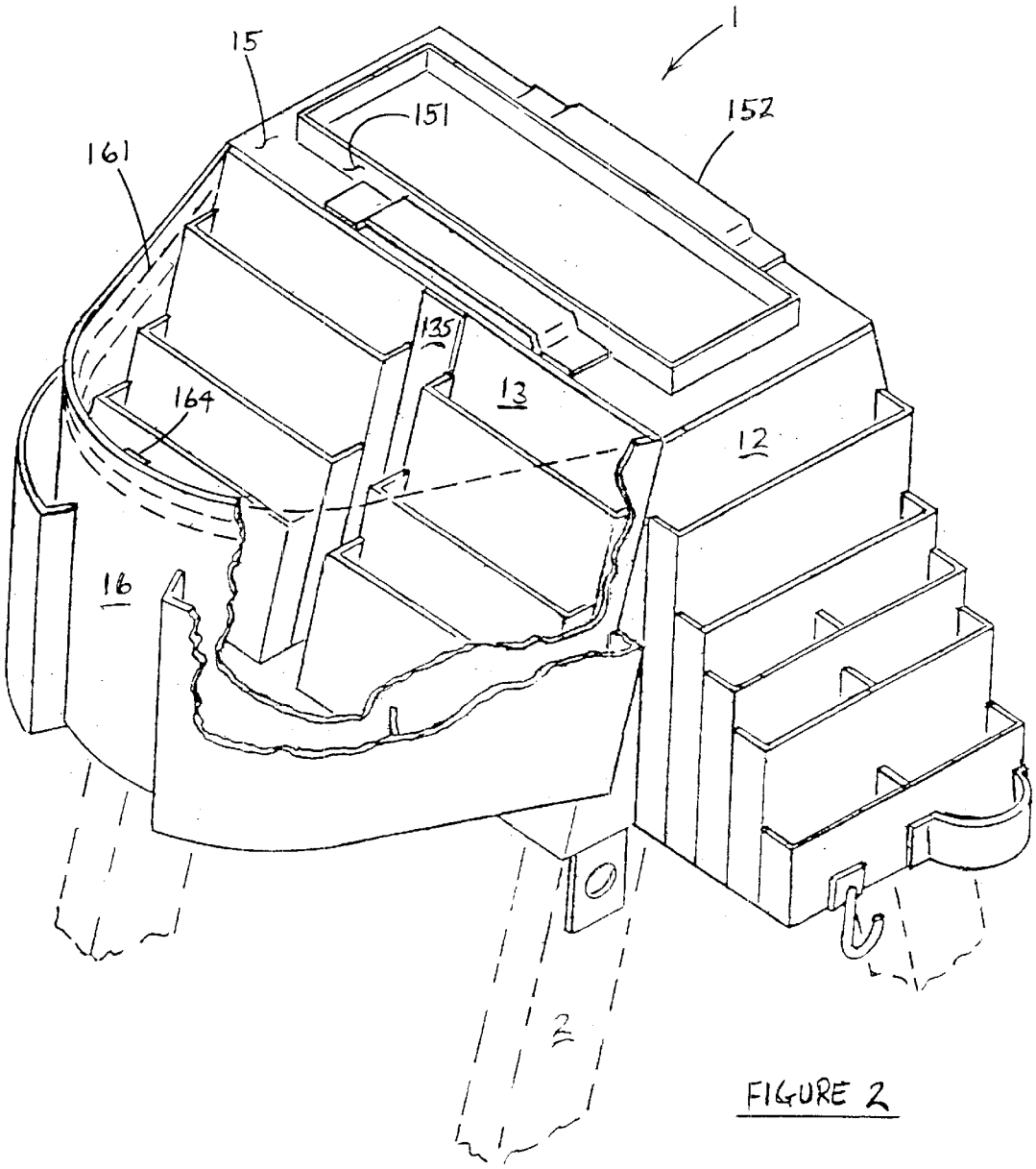
FIG. 2 is a second diagrammatic perspective view, rotated 180° in azimuth, of the preferred embodiment of the flexible truncated-pyramidally-shaped tool and material holder in accordance with the present invention previously seen in FIG. 1.

A diagrammatic perspective view of the preferred embodiment of a flexible truncated-pyramidally-shaped tool and material holder 1 in accordance with the present invention in operative position atop a step ladder 2 (shown in phantom line, for not being part of the present invention) is shown at a first angular perspective in FIG. 1, and at a second, 180°-separated, angular perspective in FIG. 2.

The holder 2 is preferably made from fabric, cloth, canvas or cotton duck, nominally of 24 oz. weight, or from polyurethane coated cloth, by processes of gluing and/or, preferably, sewing. The holder thus has angles that are gradual, and that may be less sharp than is depicted in the drawings, which are rendered to show the holder 2 with all corners sharp, and extensions full, for purposes of explaining the present invention. Due to its construction from flexible material, the holder 1 assumes the substantial geometric configuration of the structure to which it is mounted, or the apex of the step ladder 2. This makes that the holder 1 is in the substantial shape of a truncated four-side pyramid (although the pyramid is not regular, with all its angles equal).

The truncated-pyramidally-shaped tool and material holder 1 has (i) five major panels and (ii) one major loop, or pouch, that define its shape. A back panel 11 (best seen in FIG. 1) is connected along a first side edge to a corresponding first side edge of a first side panel 12 (best seen in FIG. 2) which is itself connected along its second side edge to a corresponding first side edge of a front panel 13 (best seen in FIG. 2) which is itself connected along its second side edge to a corresponding first side edge of the second side panel 14 (best seen in FIG. 1) which finally joins at its second side edge back with the second side edge of the first side panel 11. The top edges of each of the first side panel 11, the front panel 12, the second side panel 13, and the back panel 14 are connected to a corresponding four edges of the top panel 14 (seen in both FIGS. 1 and 2). The front panel 11 fits over and against uppermost regions of the rung, or step, or front portion of the stepladder 2. The back panel 14 correspondingly fits over and against uppermost regions of the back portion of the stepladder 2. Both side panels 12, 14 bridge the trapezoidally-shaped area between the legs of the step ladder 2, in other words between its front and rear portions at the apex. The top panel 15 fits on, over and against the top step of the step ladder.

The top panel 15 has and presents (i) a raised peripheral rim 151 and (ii) handles 152, both of which will be further discussed in conjunction with FIG. 8.

The major loop, or pouch, of the truncated-pyramidally-shaped tool and material holder 1 is defined by the loop, or band, 16. This loop 16 extends, as illustrated in both FIGS. 1 and 2, in an arc between, on a one side, (i) the connection of side panel 12 and front panel 13 and, on its other side, (ii) the connection of side panel 14 and front panel 13. The loop 16 is itself stiff (more so than the fabric of which the holder 1 is mostly made), or is stiffened by incorporation of an internal member 161 (shown in dashed line) so as to reliably extend in an arc, or bow (as illustrated). There may be used as member 161, for example, a length of unbreakable plastic strip which is normally positioned sewn into the loop 16 at its upper extremity, as illustrated, to impart stiffness.

Figure 3:
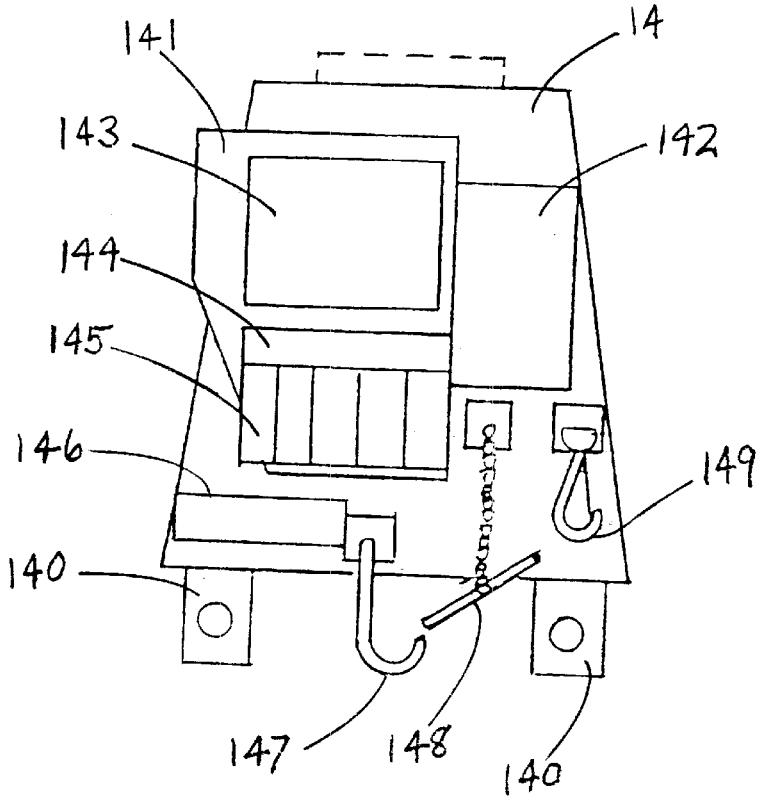
FIG. 3 is a right side plan view of the preferred embodiment of the flexible truncated-pyramidally-shaped tool and material holder in accordance with the present invention previously seen in FIGS. 1 and 2.
Figure 4:
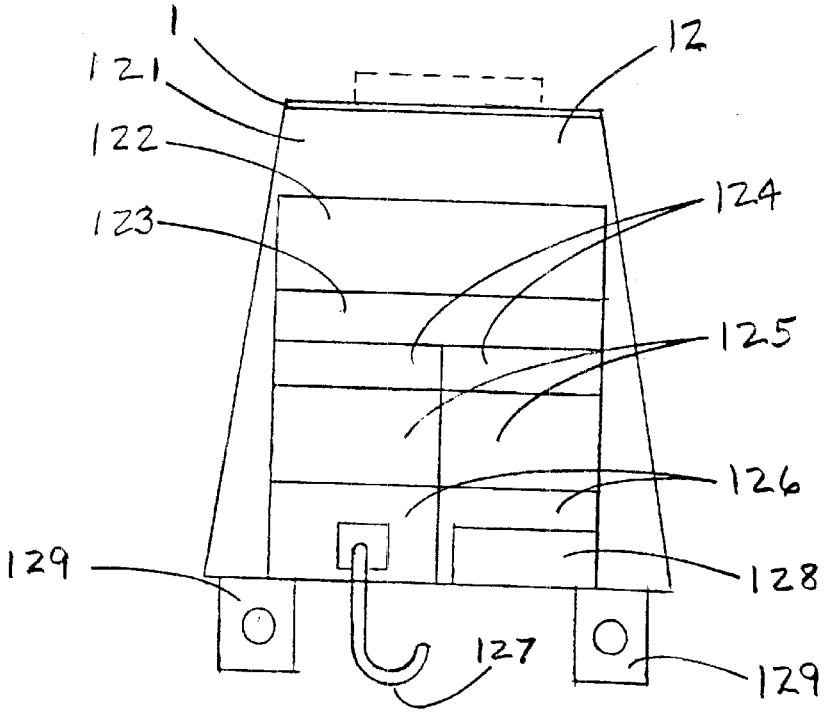
FIG. 4 is a left side plan view of the preferred embodiment of the flexible truncated-pyramidally-shaped tool and material holder in accordance with the present invention previously seen in FIGS. 1 and 2.
Figure 5:
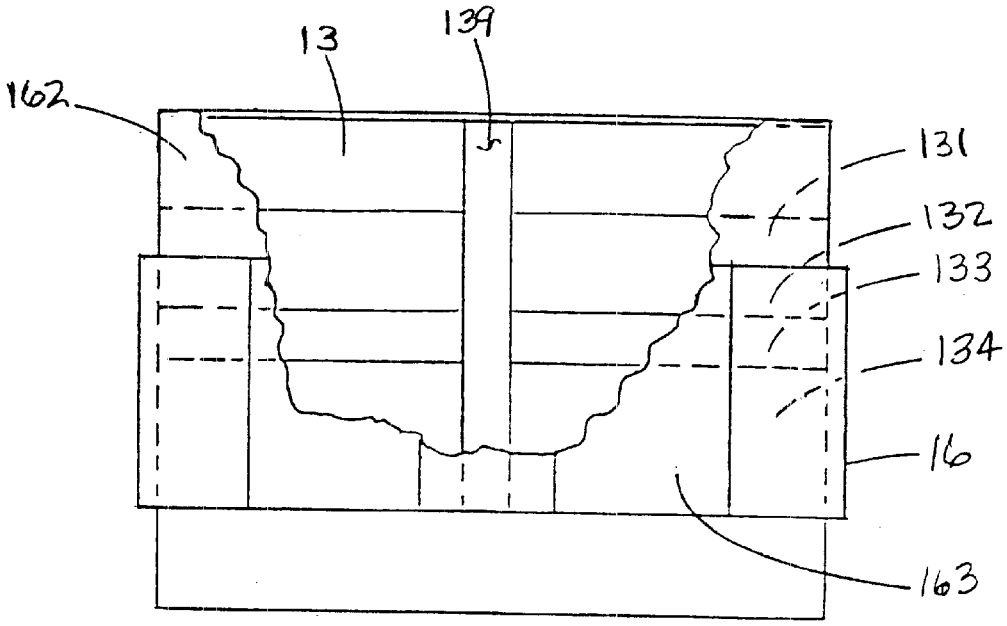
FIG. 5 is a front side plan view of the preferred embodiment of the flexible truncated-pyramidally-shaped tool and material holder in accordance with the present invention previously seen in FIGS. 1 and 2.
Figure 7:
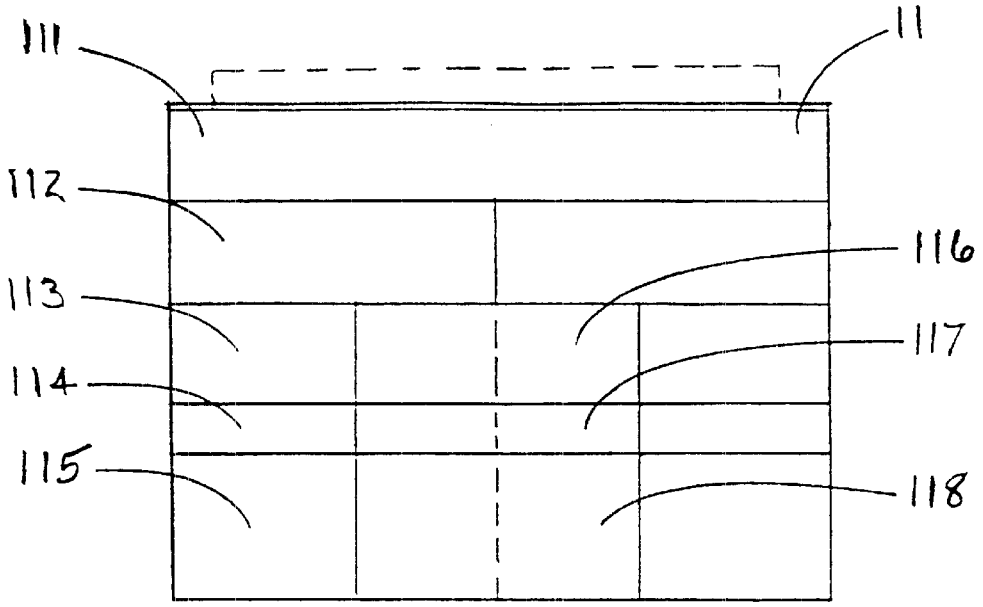
FIG. 7 is a back side plan view of the preferred embodiment of the flexible truncated-pyramidally-shaped tool and material holder in accordance with the present invention previously seen in FIGS. 1 and 2.
Figure 8A:
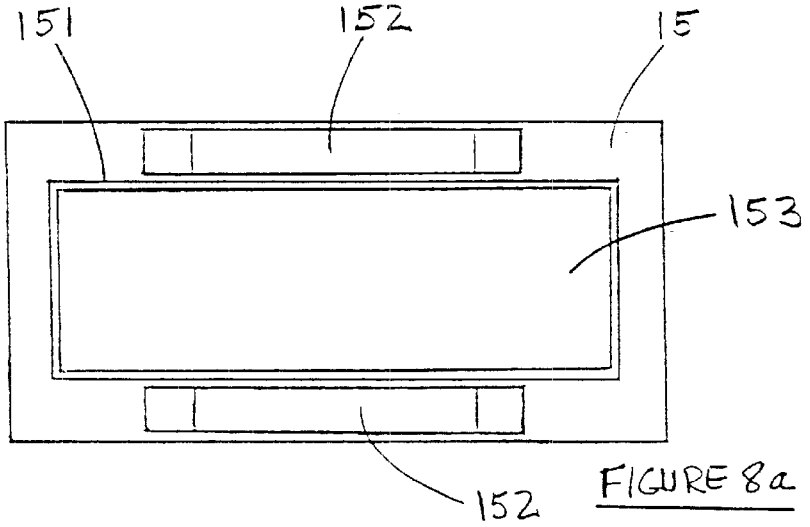
FIG. 8, consisting of FIGS. 8*a* and 8*b*, are respective detail top, and side, plan views of the top panel (only) of the preferred embodiment of the flexible truncated-pyramidally-shaped tool and material holder in accordance with the present invention previously seen in FIGS. 1 and 2.
Figure 8B:
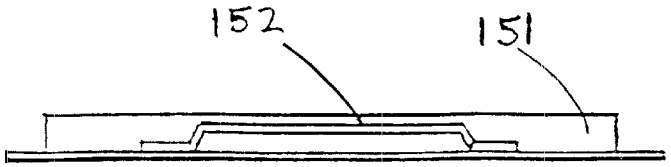

A preferred configuration of the second side panel 14 is shown in detail plan view in FIG. 3; the configuration of the first side panel 12 in FIG. 4; the configuration of the combined back panel 13 and loop panel 16 in FIG. 5; the configuration of the front panel 11 in FIG. 7; and the configuration of the top panel 15 in FIGS. 8*a* and 8*b*.

The side panel 14 has and presents, by way of example, a drill holster 141, normally of 5½" by 6¾" size; a first-level pocket 142 of nominal size 3"×4"; two second-level pockets 143 and 144 on the drill holster 141 each of nominal size 4"×3"; and a number of third-level pockets 145 each of nominal 3"×1½" size on the second-level pocket 144. There is additionally preferably provided a hammer or caulking gun loop 146, a hook 147, a tape hanger 148, a clip 149, and two tie tabs 140.

Similarly, side panel 12 shown in FIG. 4 preferably has and presents a first/level pocket 121 or nominal size 6"×10", the upper lip of which pocket 121 is joined with hook-and-loop fabric 1211. A second-level pocket 122 is of nominal size 7"×10". A third-level pocket 123 is of nominal size 7"×6". Two fourth-level pockets 124 are of nominal size 3½"×5" each; two fifth-level pockets 125 are of nominal size 3½"×4" each; and two sixth-level pockets 126 are of nominal size 3½"×2". A tie tab 127 is affixed to one of the sixth-level pockets 126, and a hammer loop 128 to the other. As with the side panel 14, two tie tabs 129 are presented.

The combination of the back panel 13 and loop panel 16 shown in FIG. 5 presents, as well as the major pouch 162 defined by the loop 16 itself, multiple pockets. Defined by the back panel 13 are a hierarchy of pockets: two first-level pockets 131, optionally sealed at the lip with hook-and-loop fastener, of nominal size 14"×8", two second-level pockets 132 of nominal size 6½" by 6" each, two third-level pockets 133 of nominal size 6½" by 4" each, and two fourth-level pockets 134 of nominal size 6½" by 3" each. The loop, or band, 16 has to its exterior preferably four first-level pockets 163 of nominal size 6" by 5" each.

Figure 6:
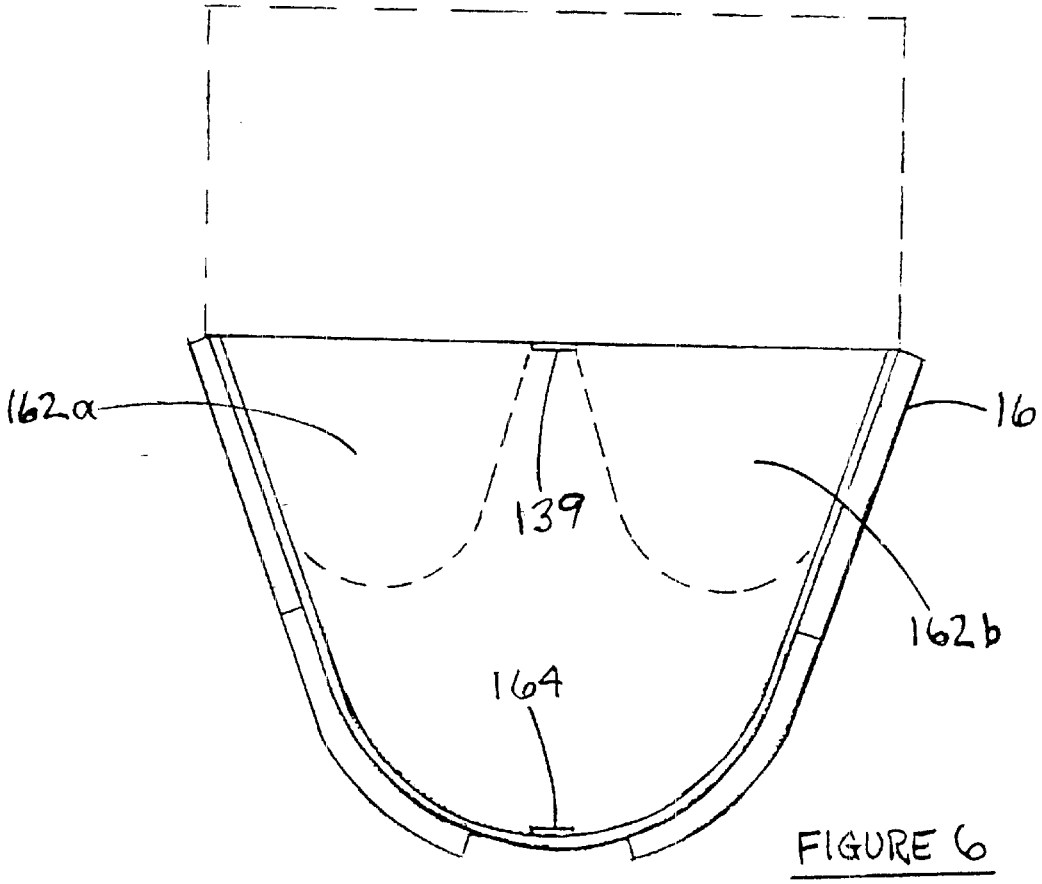
FIG. 6 is a top side plan view of the preferred embodiment of the flexible truncated-pyramidally-shaped tool and material holder in accordance with the present invention previously seen in FIGS. 1 and 2.

There is optionally included a vertical strip 135 of a first-type of hook and loop material on the exterior wall of the back panel 3, and a like strip 164 of complimentary, second-type, hook and loop material on the interior wall of the loop, or band, 16, As illustrated in FIG. 6, the two strips 135, 164 may be pressed together, drawing the major loop 16 inward so as to create two smaller arcuate loops. The plastic stiffening member 161 (see FIGS. 1 and 2), should it be present, is neither damaged nor permanently deformed by this operation, which may be reversed. The sub-pouches, or reservoirs, 162*a*, 162*b* thus created will hold small paint pails, or cans.

Continuing in FIG. 7, the front panel 11 has a plethora of pockets. Pocket 111 is of nominal size 14"×10"; two pockets 112 of nominal size 7"×8"; two pockets 113 of nominal size 4"×6"; two pockets 114 of nominal size 4"×4"; two pockets 115 of nominal size 4"×3"; one pocket 116 of nominal size 6"×6"; one pocket 117 of nominal size 6"×4"; and one pocket 118 of nominal size 6"×3".

Finally, the top panel 15 is shown in top plan view in FIG. 8*a*, and in side plan view in FIG. 8*b*. The panel 15 has a raised peripheral rim 151 which is normally made from a puckered seam of sewn fabric. It is thus very tough and resilient, and may suitably support standing. Nonetheless that the raised peripheral rim 151 creates only a shallow reservoir 153, it is sufficient to retain small nails, screws, bolts, nuts and the like within the reservoir 153, and conveniently at the top step of the step ladder 2 (shown in FIGS. 1 and 2). The elongate handles 152 are commonly made from multiple layers of the same fabric or canvas from which the holer 1 is constructed. They are sufficiently strong so as to permit the entire holder 1 and its contents to be picked up by one hand. When the holder 1 is so picked up by its handles 1, it will tend to closed and buckle along the elongate length of reservoir 151, holding securely any contents thereof, while the panels 11–14 spread at the base, facilitating both that (i) the holder 1 may subsequently be set upright upon a floor or other surface, or (ii) that (ii) the holder 1 may be conveniently readily re-positioned atop a step ladder.

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

For example, the pockets may be contoured to receive and retain specific wrenches, pliers, screwdrivers and other hand tools. For example, there may optionally be added a means for adjusting the tightness of at least one of the panels about the structural members of a step ladder, for example an elastic strap, or a pull cord.

For example, any of the pockets may optionally be sealed by any of (i) a hook-and-loop type fastener, (ii) a zipper and/or (iii) a conventional fastener selected from the group consisting of a button and a hole, a snap fastener, and a rivet.

In accordance with the preceding explanation, variations and adaptations of the flexible truncated-pyramidally-shaped tool and material holder in accordance with the present invention will suggest themselves to a practitioner of the mechanical design arts.

In accordance with these and other possible variations and adaptations of the present invention, the scope of the invention should be determined in accordance with the following claims, only, and not solely in accordance with that embodiment within which the invention has been taught.

What is claimed is:

1. A holder device for holding various things at an apex of a step ladder, the device comprising:

a) a rectangular top panel having four edges;

b) a trapezoidally-shaped first side panel (i) connected at a first edge to a first edge of the top panel, and (ii) having a plurality of receptacles;

c) a trapezoidally-shaped second side panel (i) connected at a first edge to a second edge, opposite to the top panel's first edge, of the top panel, and (ii) having a plurality of receptacles;

d) a step-side panel (i) connected at a first edge to a third edge of the top panel, and also to a second edge of both the first and the second side panels, and (ii) having a plurality of receptacles;

e) a front panel, connected at a first edge to a fourth edge of the top panel and also to a third edge, opposite to the second edges, of both first and the second side panels;

f) a loop member extending substantially level with the top panel from (i) where the top panel joins with the first side panel and the front panel (ii) in an arc to (iii) where the top panel joins with the second side panel and the front panel, so as to form a loop into which a paint can is suitably entered and held.

2. The holder device according to claim 1 wherein the loop member comprises:

a shape memory stiffening element for maintaining the arc of the loop into which the paint can is suitably entered and held even when the paint can is not present.

3. The holder device according to claim 1 wherein the loop member comprises:

a downhanging skirt protecting and securing a cylindrical surface of a paint can entered into, and held by, the loop member.

4. The holder device according to claim 3 wherein the downhanging skirt comprises:

a substantially vertical strip of a first type of hook-and-loop fabric;

and wherein the front panel comprises:

a substantially vertical strip of a second type of hook-and-loop fabric complimentary to the first type;

wherein when the strips of the downhanging skirt and of the front panel are manually pressed together than they will hold along their lengths, dividing a major arc of the loop member into two smaller arcs each of which is suitable to receive and to hold a paint can of appropriate size.

5. The holder device according to claim 1 used on a step ladder with a top step at an apex wherein the top panel comprises:

a peripheral rim (i) sufficiently high so as to form a shallow reservoir in which can be placed nails and screws and other small things without jeopardy that they will role off the holder device and the step ladder, but (ii) insufficiently high so as to preclude that a person should not stand upon the top panel and a rim and a reservoir of the top panel, obtaining good and secure footing like as the person would obtain standing directly upon the top step of the step ladder.

6. The holder device according to claim 1 wherein connecting of all panels is by sewing.

7. A holder device suitable to hold nails and screws and other small things at a top step of a step ladder, the device comprising:

a) a rectangular top panel having (i) four edges and (ii) a peripheral rim sufficiently high so as to form a shallow reservoir suitable to contain nails and screws and other small things without jeopardy that they will roll out of the reservoir and off the top panel and the step ladder but insufficiently high so as to preclude that a person should not stand upon the top panel and a rim and a reservoir of the top panel when the top panel is mounted flat at the top step of the step ladder;

b) a trapezoidally-shaped first side panel (i) connected at a first edge to a first edge of the top panel to extend generally downward, and (ii) having a plurality of receptacles;

c) a trapezoidally-shaped second side panel (i) connected at a first edge to a second edge, opposite to the top panel's first edge, of the top panel to extend generally downward, and (ii) having a plurality of receptacles;

d) a step-side panel (i) connected at a first edge to a third edge of the top panel, and also to a second edge of both the first and the second side panels, to extend generally downward and (ii) having a plurality of receptacles; and e) a front panel, connected at a first edge to a fourth edge of the top panel and also to a third edge, opposite to the second edges, of both first and the second side panels to extend generally downward; and f) a loop member extending substantially level with the top panel from (i) where the top panel joins with the first side panel and the front panel (ii) in an arc to (iii) where the top panel joins with the second side panel and the front panel, so as to form a loop into which a paint can is suitably entered and held;

wherein the connected (i) top and (ii) downward-extending panels collectively constitute a holder device that is suitably mounted at the top step of a step ladder with the top panel overlying the top step, with the step-side panel overlying an uppermost portion of a step side of the step ladder, with the front panel overlying an uppermost portion of a front side of the step ladder, and with each of the two side panels overlying regions between the step side and the front side of the step ladder.

8. The holder device according to claim 7 wherein the loop member comprises:

a shape memory stiffening element for maintaining the arc of the loop into which the paint can is suitably entered and held even when the paint can is not present.

9. The holder device according to claim 7 wherein the loop member comprises:

a downhanging skirt protecting and securing a cylindrical surface of a paint can entered into, and held by, the loop member.

10. The holder device according to claim 9 wherein the downhanging skirt comprises:

a substantially vertical strip of a first type of hook-and-loop fabric;

and wherein the front panel comprises:

a substantially vertical strip of a second type of hook-and-loop fabric complimentary to the first type;

wherein when the strips of the downhanging skirt and of the front panel are manually pressed together than they will hold along their lengths, dividing a major arc of the loop member into two smaller arcs each of which is suitable to receive and to hold a paint can of appropriate size.

11. A holder device suitable to caddy various tools and materials to a step ladder, and for holding these same tools and material plus a paint pail upon the step ladder, the holder device comprising:

a durable fabric body in the substantial shape of (i) a truncated four-sided pyramid with five major surfaces comprising a top surface and four side surfaces, plus (ii) a flexible arcuate loop extending from edge to edge of a one side of one of the side surfaces; and a multiplicity of fabric receptacles upon the at least one of the four side surfaces of the fabric body;

wherein the fabric body with fabric receptacles is placeable atop a step ladder;

wherein a paint pail is suitably entered into, and held by, the arcuate loop when the fabric body placed atop the step ladder; and wherein tools and materials are suitably entered into, and held by, the multiple fabric receptacles of the at least one side surface of the fabric body when the fabric body is placed atop the step ladder.

12. The holder device as set forth in claim 11 wherein a multiplicity of fabric receptacles are upon at least three of the four side surfaces of the fabric body.

13. The holder device as set forth in claim 12 wherein a multiplicity of fabric receptacles are upon all four of the four side surfaces of the fabric body.

* * * * *